US006830489B2

(12) United States Patent
Aoyama

(10) Patent No.: US 6,830,489 B2
(45) Date of Patent: Dec. 14, 2004

(54) WIRE HOLDING CONSTRUCTION FOR A JOINT CONNECTOR AND JOINT CONNECTOR PROVIDED THEREWITH

(75) Inventor: Masahiko Aoyama, Yokkaichi (JP)

(73) Assignee: Sumitomo Wiring Systems, Ltd., Yokkaichi (JP)

( * ) Notice: Subject to any disclaimer, the term of this patent is extended or adjusted under 35 U.S.C. 154(b) by 0 days.

(21) Appl. No.: 10/337,112

(22) Filed: Jan. 6, 2003

(65) Prior Publication Data

US 2003/0143898 A1 Jul. 31, 2003

(30) Foreign Application Priority Data

Jan. 29, 2002 (JP) ..... 2002-019953

(51) Int. Cl.[7] ..... H01R 13/502

(52) U.S. Cl. ..... 439/701; 439/719; 439/695; 439/686; 439/465; 439/456

(58) Field of Search ..... 439/701, 465, 439/456–457, 719, 695, 686

(56) References Cited

U.S. PATENT DOCUMENTS 4,108,527 A * 8/1978 Douty et al. ..... 439/465
5,133,674 A * 7/1992 Albrecht ..... 439/465
5,380,220 A * 1/1995 Okabe ..... 439/456
5,520,550 A * 5/1996 Okabe ..... 439/404
5,569,050 A * 10/1996 Lloyd ..... 439/465
5,997,362 A * 12/1999 Hatagishi et al. ..... 439/701
6,007,386 A * 12/1999 Okabe ..... 439/701
6,558,185 B1 * 5/2003 Stockel et al. ..... 439/465

FOREIGN PATENT DOCUMENTS

JP 5-65073 8/1993

* cited by examiner

*Primary Examiner*—Truc T. T. Nguyen
(74) *Attorney, Agent, or Firm*—Gerald E. Hespos; Anthony J. Casella

(57) ABSTRACT

A joint connector has wire holders (15*a*, 15*b*, 15*c*) that project in a wire draw-out direction from wire draw-out portions (14*b*) of housings (12*a*, 12*b*, 12*c*) where wires (W) connected with terminal fittings (20) are drawn out. The wires (W) are held tightly between the inner surfaces of the opposite wire holding portions (15*a*, 15*b*, 15*c*). Holding projections (16) project from the inner surfaces of the wire holding portions (15*a*, 15*b*, 15*c*) toward the opposite surfaces, so that the wires (W) can be so held as not to come out while being partly squeezed.

15 Claims, 8 Drawing Sheets

WIRE HOLDING CONSTRUCTION FOR A JOINT CONNECTOR AND JOINT CONNECTOR PROVIDED THEREWITH

BACKGROUND OF THE INVENTION

1. Field of the Invention

The invention relates to a wire holding construction for a joint connector as well as to a joint connector provided therewith.

2. Description of the Related Art

Japanese Unexamined Utility Model Publication No. 5-65073 and FIGS. 10(A) and 10(B) herein disclose a joint connector 1 with housings 2*a*, 2*b*, 2*c*. Each housing 2*a*, 2*b*, 2*c* has cavities 3 with open upper surfaces for receiving insulation-displacement terminal fittings T. The terminal fittings T are inserted in the respective cavities 3 and connected to wires W. The housings 2*a*, 2*b*, 2*c* then are joined one over another to position and hold the terminal fittings T between the housings 2*a*, 2*b*, 2*c*.

The insulation displacement terminal fittings T have slots that connect to the wires W without stripping the insulation coating of the wires W. However, pulling forces can withdraw the wires W from the insulation-displacement terminal fittings T, and the prior art joint connector 1 has no structure to prevent such withdrawal.

The invention was developed in view of the above problem and an object is to prevent wires from being pulled out of the joint connector.

SUMMARY OF THE INVENTION

The invention relates to a wire holding construction for a joint connector with a plurality of housings placed one over another. The housings have cavities for accommodating terminal fittings. The respective housings have wire draw-out portions, and wires connected with the terminal fittings are drawn out from the wire draw-out portions. Wire holders project in a wire draw-out direction from wire draw-out portions of the housings. Holding projections are formed on the inner surfaces of the wire holders and project substantially toward opposed inner surfaces. Thus, the wires are squeezed between the holding projections on the inner surfaces of opposed wire holders so that the wires will not come out.

The terminal fittings may be insulation displacement terminal fittings, and may have a small holding force against a wire pulling force. Small crimping terminal fittings that have a similarly small holding force also may be used.

The housings and the wire holders that are placed one over another may be joined by locks. The locks may comprise resilient claws that engage in grooves. The locks also may comprise projections that engage locking holes.

The wires drawn out from the respective housings can be held by the opposed holding projections of the wire holders while the housings are placed one over another and joined. The wire holders project from the housings substantially in the wire draw-out direction. Thus, the assembled joint connector can be handled while preventing the wires from being pulled directly during the operation.

Each holding projection may comprise ribs that extend at an angle to the wire draw-out direction. Thus, the wire is squeezed at spaced apart positions to provide enhanced resistance against pulling forces on the wire.

The wire holding portions may be formed separately from the corresponding housing and may be detachably attached to the housing. Thus, a change in the diameter of the wires to be held by the wire holders can be dealt with easily merely by preparing a plurality of kinds of wire holders and changing the wire holders. The housings may be used without attaching the wire holders if the joint connector is used where no pulling force will act on the wires.

Each wire may comprise a sheath for covering a plurality of thin parallel wires and may be squeezed between opposed holding projections so as not to come out. Thus, the wires can be held together by one wire holder, and a change in the diameter of the wires can be dealt with. Further, squeezing forces exerted by the holding projections are applied to the sheath and not directly to the wires. Thus, troubles such as fracture or breakage of the wires caused by squeezing can be avoided.

Guiding means are placed substantially one over another for positioning the wire holders with respect to each other.

The invention, also relates to a joint connector comprising a wire holding construction.

Locks may be provided for locking the housings together.

Preferably, one of the housings is formed as a lid for substantially covering an end portion of the joint connector.

Parts of the housings may be connected to each other by hinge means.

Most preferably, at least some of the housings are lockable to each other by hook means.

These and other objects, features and advantages of the present invention will become more apparent upon reading of the following detailed description of preferred embodiments and accompanying drawings. It should be understood that even though embodiments are described separately, single features thereof may be combined to additional embodiments.

DETAILED DESCRIPTION OF THE PREFERRED EMBODIMENTS

FIGS. 1 to 7 show a joint connector 11 according to a first embodiment of the invention. The joint connector 11 has housings 12*a*, 12*b*, 12*c* made e.g. of a synthetic resin and arranged substantially one over another along a connecting direction. The middle and bottom housings 12*b*, 12*c* have cavities 13 for accommodating insulation displacement terminal fittings 20. The terminal fittings 20 are held in the cavities 13 before being connected with wires W such that the leading ends of the terminal fittings 20 are near connecting ends 14*a* of the cavities 13 at the front ends of the housings 12*b*, 12*c* and such that the rear ends of the terminal fittings 20 extend in a wire draw-out direction WDD toward the wire draw-out portions 14*b* of the cavities 13.

The middle and bottom housings 12*b*, 12*c* are constructed so that three or more housings of the same type can be placed one over another. The uppermost housing 12*a* functions as a lid. A lock arm 12*d* is provided on the upper surface of the upper housing 12*a* for fixedly connecting the joint connector 11 with a mating connector (not shown).

Figure 5:
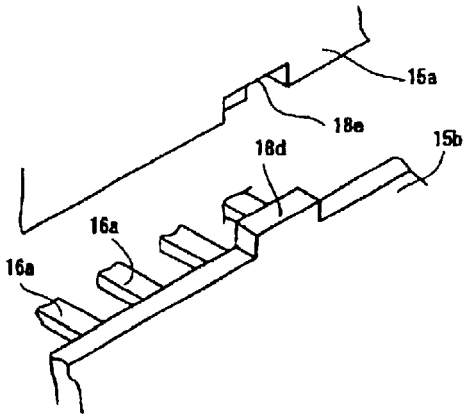
FIG. 5 is a perspective view showing a separated state of wire holders.
Figure 6A:
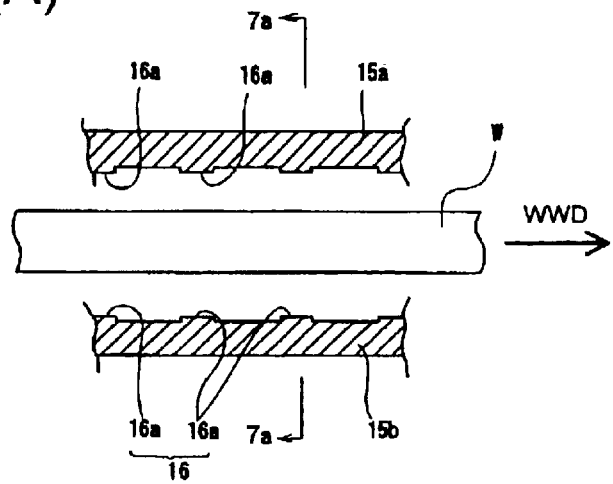
FIG. 6(A) is a partial section showing a state where the wire is between the wire holders, and 6(B) is a partial section showing a state where the wire is squeezed by the wire holders.
Figure 6B:
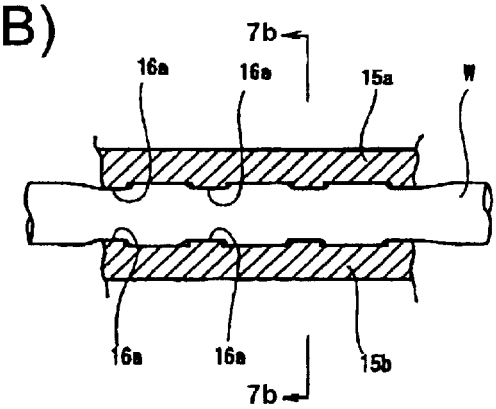

Substantially plate-shaped wire holders 15*a*, 15*b*, 15*c* project unitarily substantially in the wire draw-out direction WDD adjacent the wire draw-out portions 14*b* of the respective housings 12*a*, 12*b*, 12*c*. Holding projections 16 project from inner surfaces of the wire holders 15*a*, 15*b*, 15*c* and define opposed pairs when the housings 12*a*, 12*b*, 12*c* are placed one over another. Each holding projection 16 has ribs 16*a* that extend substantially normal to the longitudinal direction of the wire W, as shown in FIG. 5. The ribs 16*a* of the respective wire holding portions 15*a*, 15*b*, 15*c* are substantially opposed, as shown in FIGS. 6(A) and 6(B), to squeeze the held wire W at four positions so as not to come out.

Figure 4A:
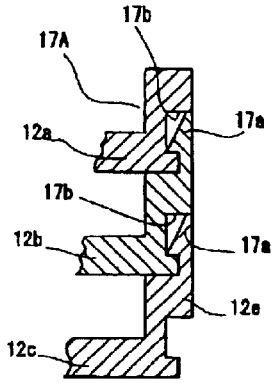
FIGS. 4(A) and 4(B) are sections showing essential parts of locks.
Figure 4B:
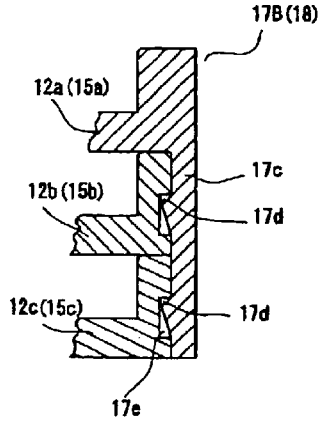

The housings 12*a*, 12*b*, 12*c* and the wire holders 15*a*, 15*b*, 15*c* have locks 17, 18 for fixing the housings 12*a*, 12*b*, 12*c* in their joined state. More particularly, locks 17 are at front and rear positions of both side walls 12*e* in each housing 12*a*, 12*b*, 12*c*. As shown in FIG. 4(A), each front lock 17A is comprised of a resilient locking claw 17*a* that projects up from the corresponding side wall 12*e* and a locking groove 17*b* that engages with the mating locking claw 17*a* of the adjacent housing 12 when the housings 12*a*, 12*b*, 12*c* are placed one over another. Each rear lock 17B is comprised of a locking projection 17*d* and a locking groove 17*e*. The locking projection 17*d* is on the inner surface of a guiding piece 17*c* that hangs down from a corresponding side wall 12*e* of the uppermost housing 12*a* over the housings 12*b*, 12*c* to be placed. The locking groove 17*e* is in the corresponding side wall 12*e* of the housing 12*b*, 12*c* as shown in FIG. 4(B).

Each lock 18 between the wire holders 15*a*, 15*b*, 15*c* comprises a projection 18*b* and a groove 18*c*. The projection 18*b* is on the inner surface of a guide 18*a* that hangs down from each side wall 15*d* of the wire holding portion 15*a*. The groove 18*c* is formed at a corresponding position of a side wall 15*d* of the wire holder 15*b*, 15*c*. A projection 18*d* and a recess 18*e* are formed at a middle position of each side wall 15*d* for positioning the wire holders 15*a*, 15*b*, 15*c* when the wire holders 15*a*, 15*b*, 15*c* are placed one over another, as shown in FIG. 5.

Figure 3:
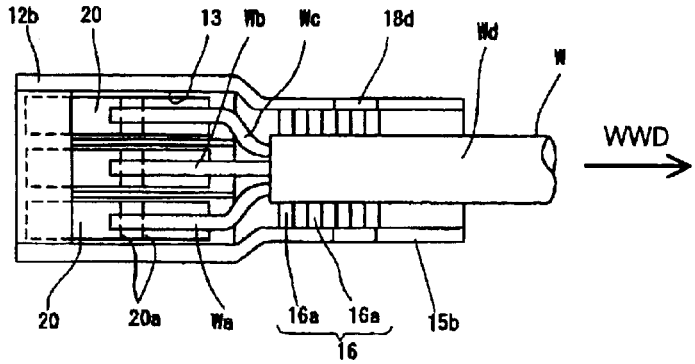
FIG. 3 is a plan view showing a state where terminal fittings connected with a wire is placed in the housing.
Figure 7A:
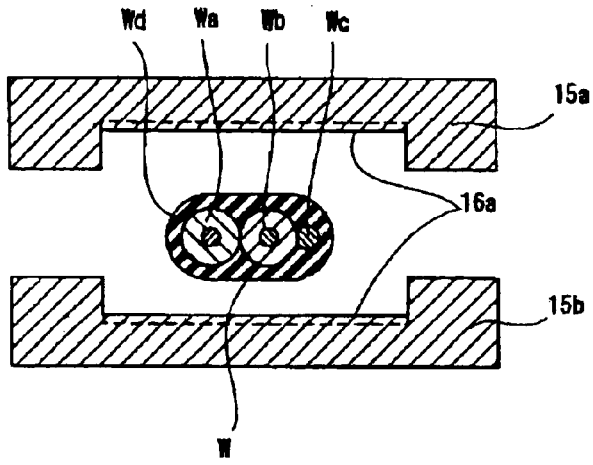
FIG. 7(A) is a section along 7A—7A of FIG. 6(A) and FIG. 7(B) is a section along 7B—7B of FIG. 6(B).
Figure 7B:
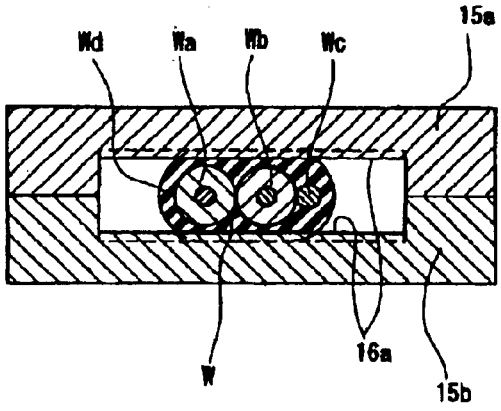

Each wire W has two thin wires Wa, Wb and a drain wire Wc arranged side by side and covered by a sheath Wd, as shown in FIGS. 7(A) and 7(B). The sheath Wd is stripped off at an end of each wire W to expose the thin wires Wa, Wb and the drain wire Wc, as shown in FIG. 3. The sheath Wd is held tightly in a tight holding area by the wire holder 15*a*, 15*b*, 15*c*. However, the exposed thin wires Wa, Wb and drain wire Wc are held in correspondence with the respective terminal fittings 20 to be connected in the housing 12*a*, 12*b*, 12*c*.

Figure 1:
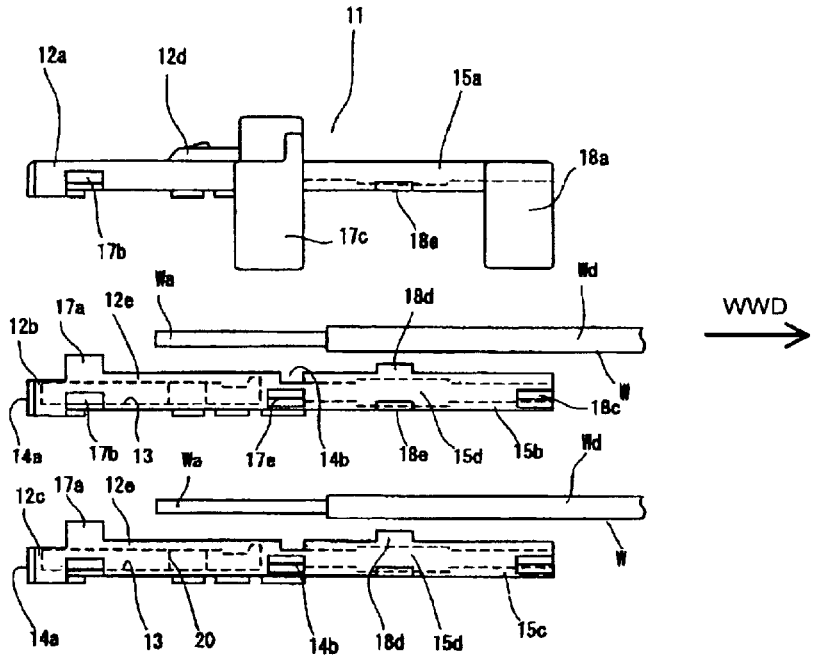
FIG. 1 is an exploded diagram of a wire holding construction in a joint connector according to a first embodiment of the invention.

As shown in FIG. 1, the terminal fittings 20 are placed in separate cavities 13 of the housings 12*b*, 12*c*. Subsequently, the wire W is placed along the housing 12*b*, 12*c* and the wire holder 15*b*, 15*c*. The two thin wires Wa, Wb and the drain wire Wc then are pressed by a pressing apparatus (not shown) into clearances between insulation-displacement blades 20*a* of the terminal fittings 20 for connection with the terminal fittings 20 by insulation displacement. In this way, the sheaths Wd of the wire W are placed on the wire holders 15*b*, 15*c*.

Figure 2:
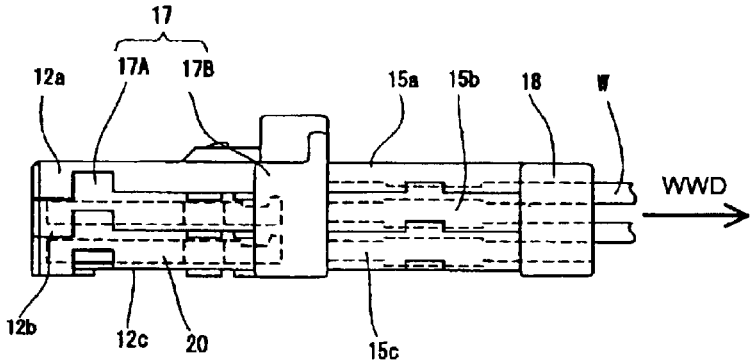
FIG. 2 is a diagram showing a joined state of housings.

The respective housings 12*a*, 12*b*, 12*c* and the wire holders 15*a*, 15*b*, 15*c* then are placed one over another and pressed, as shown in FIG. 2. Thus, the housings 12*a*, 12*b*, and 12*c* are joined one over another by the action of the locks 17, 18. At this stage, the wires W are squeezed between opposed upper and lower ribs 16*a* of the holding projections 16 in the wire holders 15*a*, 15*b*, 15*c*, as shown in FIGS. 6(B) and 7(B). Thus, forces for holding the wire W against a pulling force in withdrawing direction are strengthened in the wire holder 15*a*, 15*b*, 15*c*, and the wire W is prevented from being disengaged from the terminal fitting 20 even if a pulling force acts thereon.

Figure 8A:
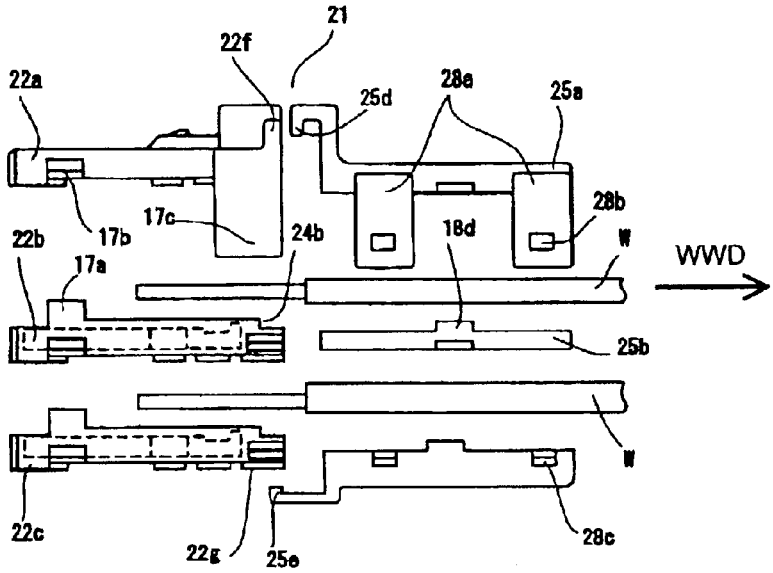
FIG. 8(A) is an exploded diagram showing a wire holding construction in a joint connector according to a second embodiment.

A joint connector according to a second embodiment of the invention is identified by the numeral 21 in FIG. 8(A). The joint connector 21 has housings 22*a*, 22*b*, 22*c* and separate wire holders 25*a*, 25*b*, 25*c* that are releasably connectable with the housings 22*a*, 22*b*, 22. Hook-shaped locking pieces 25*d* are formed at opposite sides of the upper surface of an end of the upper wire holder 25*a* and are configured to engage jaws 22*f* at opposite sides of the upper surface of an end of the housing 22*a*. Similarly, hook-shaped locking pieces 25*e* are formed at the opposite sides of the lower surface of an end of the lower wire holder 25*c* and are configured to engage jaws 22*g* at opposite sides of the lower surface of an end of the housing 22*c*. The wire holder 25*a* has locks 28, each of which has a guiding piece 28*a* formed with a locking hole 28*b*. The wire holder 25*c* also has a locking projection 28*c* that engages the locking hole 28*b* of the guiding piece 28*a*. The wire holding construction defined by the holding projections 16 on the inner surfaces of the wire holders 25*a*, 25*b*, 25*c* is the same as in the first embodiment. Since the other construction is similar to or the same as in the first embodiment, no description is given, and the similar parts merely are identified by the same reference numerals.

Figure 8B:
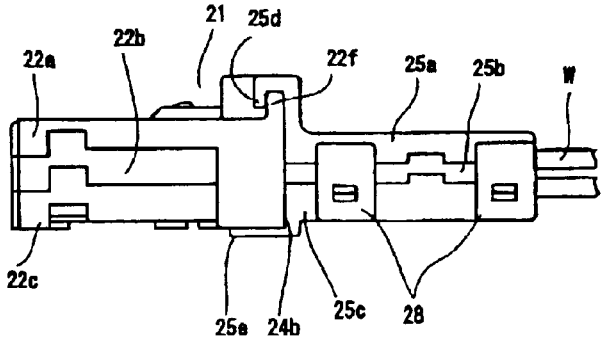
FIG. 8(B) is a diagram showing a joined state of the joint connector.

FIG. 8(B) shows a joined state of the joint connector 21 of the second embodiment. Forces for holding the wires W against pulling forces are provided by the holding projections 16 on the inner surfaces of the wire holders 25*a*, 25*b*, 25*c*, as in the first embodiment. The wire holding portions 25*a*, 25*b*, 25*c* are detachable in the second embodiment. Thus, the housings 22*a*, 22*b*, 22*c* may be used without using the wire holding portions 25*a*, 25*b*, 25*c* if the joint connector 21 is used at a position where no pulling force will act on the wires W.

Figure 9:
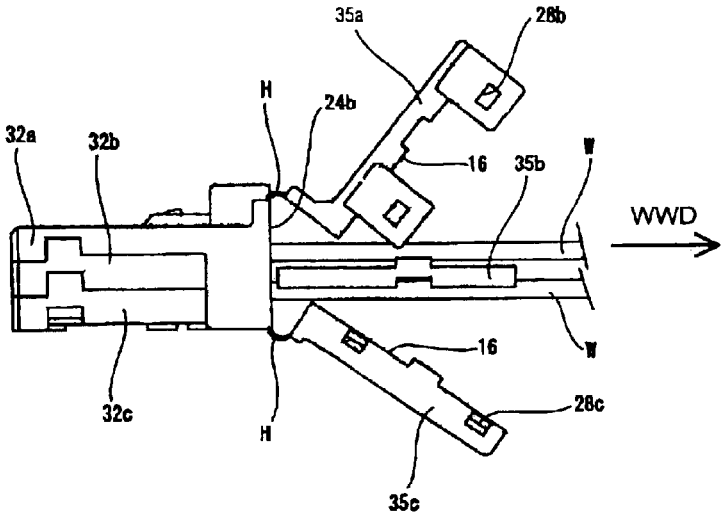
FIG. 9 is a diagram showing a wire holding construction in a joint connector according to a third embodiment.
Figure 10A:
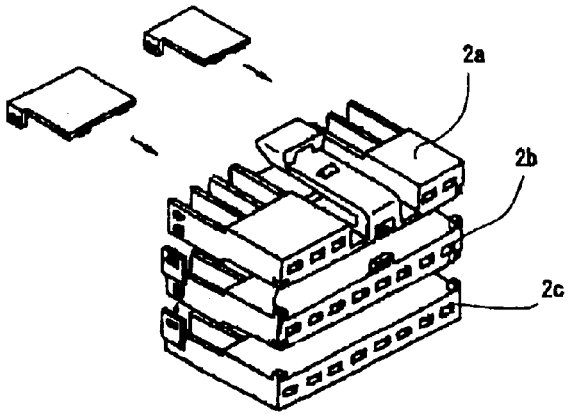
FIG. 10(A) PRIOR ART
FIGS. 10(A) and 10(B) are diagrams showing a prior art joint connector.
Figure 10B:
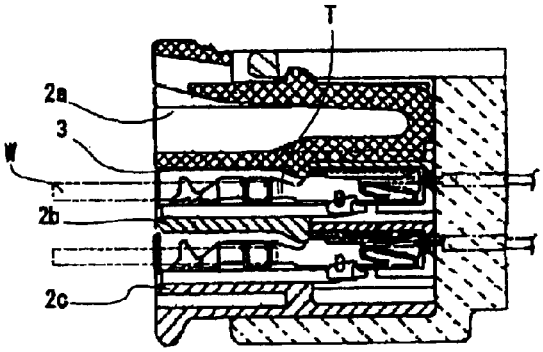
FIG. 10(B) PRIOR ART

A joint connector 31 according to a third embodiment of the invention is identified by the numeral 31 in FIG. 9. The joint connector 31 has upper and lower wire holding portions 35*a*, 35*c* that are coupled by hinges H to ends of corresponding housings 32*a*, 32*c* at the side of wire draw-out portions 24*b*. The middle wire holding portion 35*b* is formed separately from the housing 32*b* as in the second embodiment. However, it may project integrally or unitarily from the housing 32*b* as in the first embodiment. Holding projections 16 are formed on the inner surfaces of the wire holding portions 35*a*, 35*b*, 35*c* substantially as in the first embodiment for holding the wires W. The other construction is similar to or the same as in the second embodiment. Thus, no description is given, and the similar parts merely are identified by the same reference numerals.

The terminal fittings connected with the wires W are fixed by joining the housings 32*a*, 32*b*, 32*c*. The separately formed wire holder 35*b* then is disposed between the wires W and the upper and lower wire holders 35*a*, 35*c* coupled by the hinges H are rotated in the closing direction. Forces for holding the wires W against pulling forces are provided by joining the wire holders 35*a*, 35*c* by the locks 28 comprised of the locking holes 28*b* and the locking projections 28*c*. The housings 32*a*, 32*b*, 32*c* of the joint connector 31 are joined initially and position the wires W. The wire holders 35*a*, 35*b*, 35*c* then are joined to hold the properly positioned wires W. Thus, efficiency of joining the wire holders 35*a*, 35*b*, 35*c* is improved. Further, there is no danger of losing the wire holders 35*a*, 35*c* since they are coupled via the hinges H.

The wires are formed by covering the two thin wires and the drain wire in the foregoing embodiments. However, the invention is also applicable to wires containing thinner wires or flat wires with no sheath and/or no drain wire. Further, the ribs of the holding projections are opposed when the upper and lower wire holders are joined. However, the upper and lower holders may be offset to the ribs of the lower holding projection to hold the wire in a zigzag manner.

As is clear from the above description, the housings that accommodate the terminal fittings are joined by being placed one over another, and the wires drawn out from the joined housings can be held simultaneously by the wire holding portions that are formed integrally or separately in the joint connector. The wires are squeezed by the holding projections of the wire holding portions. Thus, a pulling force on the wires does not act on the terminal fittings, and the wires will not disengage from the terminal fittings.

What is claimed is:

1. A wire holding construction for a joint connector with at least first, second and third housings disposed one over the other, cavities defined between the first and second housings and between the second and third housings for accommodating terminal fittings at least first, second and third wire holders projecting in a wire draw-out direction from wire draw-out portions of the respective housings, wires to be connected with the terminal fittings can be drawn out from the wire draw-out portions and through spaces between the first and second wire holders and between the second and third wire holders, the wires being tightly held between inner surfaces of the opposite first and second wire holders and between inner surfaces of the opposite second and third wire holders, and holding projections being formed on the inner surfaces of the wire holders, the holding projections on the first and third wire holders projecting towards opposing surfaces of the second wire holder, and the holding projections on the second wire holders projecting toward opposing surfaces on the first and third wire holders, so that the wires are squeezed between the holding projections on opposing surfaces and do not come out.

2. The wire holding construction of claim 1, wherein each holding projection comprises a plurality of ribs extending substantially normal to the wire draw-out direction.

3. The wire holding construction of claim 2, wherein each wire holder is formed separately from the corresponding housing and is detachably attached thereto.

4. The wire holding construction of claim 1, wherein each wire comprises a sheath for covering a plurality of thin wires arranged substantially side by side and is held so as not to come out by having the sheath squeezed by the holding projections.

5. The wire holding construction of claim 1, wherein guiding means are provided for positioning the wire holders with respect to each other when the wire holders are placed substantially one over another.

6. A joint connector comprising: a at least first, second and third housings disposed one over the other, cavities formed between the first and second housings and between the second and third housings for accommodating terminal fittings, each said housing having a wire draw-out portion for accommodating wires in a wire draw-out direction, first, second and third wire holders projecting in the wire draw-out direction from the wire draw-out portions of the respective housings for accommodating the wires, and holding projections being formed on inner surfaces of the wire holders and projecting towards opposing surfaces for squeezing at least one wire between the holding projections on the first and second wire holders and for squeezing at least one wire between the holding projections on the second and third wire holders.

7. The joint connector of claim 6, further comprising locks for locking the respective housings with each other.

8. The joint connector of claim 7, wherein one of the housings is a lid for substantially covering an end of the joint connector.

9. The joint connector of claims 6, wherein the first and third wire holders are movably connected to the respective first and third housings by a hinges.

10. The joint connector of claim 6, wherein the housings are lockable to each other by hooks.

11. A joint connector comprising: a at least first, second and third housings disposed one over the other, cavities formed between the first and second housings and between the second and third housings, terminal fittings accommodated in the cavities and wires connected to the terminal fittings, each said housing having a wire draw-out portion for accommodating the wires in a wire draw-out direction, at least first, second and third wire holders projecting in the wire draw-out direction from the wire draw-out portions of the respective housings for accommodating the wires, and holding projections being formed on inner surfaces of the wire holders and projecting towards opposing surfaces for squeezing at least a first of the wires between the first and second wire holders and for squeezing at least a second of the wires between the second and third wire holders for holding the wires in the joint connector.

12. The joint connector of claim 11, further comprising locks for locking the respective housings with each other.

13. The joint connector of claim 12, wherein one of the housings is a lid for substantially covering an end of the joint connector.

14. The joint connector of claims 11, wherein the first and third wire holders are movably connected to the respective first and third housings by a hinges.

15. The joint connector of claim 11, wherein the housings are lockable to each other by hooks.

* * * * *